US011022125B2

(12) United States Patent
Okada et al.

(10) Patent No.: US 11,022,125 B2
(45) Date of Patent: Jun. 1, 2021

(54) CENTRIFUGAL COMPRESSOR

(71) Applicant: MITSUBISHI HEAVY INDUSTRIES COMPRESSOR CORPORATION, Tokyo (JP)

(72) Inventors: Noriyuki Okada, Tokyo (JP); Yuji Masuda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 89 days.

(21) Appl. No.: 16/478,886

(22) PCT Filed: Feb. 20, 2018

(86) PCT No.: PCT/JP2018/005871
§ 371 (c)(1),
(2) Date: Jul. 18, 2019

(87) PCT Pub. No.: WO2018/159371
PCT Pub. Date: Sep. 7, 2018

(65) Prior Publication Data

US 2020/0056617 A1 Feb. 20, 2020

(30) Foreign Application Priority Data

Feb. 28, 2017 (JP) ..... JP2017-036142

(51) Int. Cl.
*F04D 17/12* (2006.01)
*F04D 29/42* (2006.01)
(Continued)

(52) U.S. Cl.
CPC ..... *F04D 17/12* (2013.01); *F04D 29/4213* (2013.01); *F04D 29/5853* (2013.01); *F04D 29/624* (2013.01)

(58) Field of Classification Search
None
See application file for complete search history.

(56) References Cited

U.S. PATENT DOCUMENTS 4,531,356 A * 7/1985 Linder ..... F02C 7/045 415/119
2015/0330407 A1* 11/2015 Klett ..... F04D 29/584 415/48

FOREIGN PATENT DOCUMENTS

GB 507264 A * 6/1939 ..... F01D 25/00
JP S48-18811 A 3/1973
(Continued)

OTHER PUBLICATIONS

International Search Report and Written Opinion in corresponding International Application No. PCT/JP2018/005871, dated May 22, 2018 (6 pages).
(Continued)

*Primary Examiner* — Ninh H. Nguyen
*Assistant Examiner* — Jason Fountain
(74) *Attorney, Agent, or Firm* — Osha Bergman Watanabe & Burton LLP

(57) ABSTRACT

A centrifugal compressor includes: a rotor that includes a shaft rotatably disposed inside a casing and impellers fixed to an outer periphery of the shaft; a diaphragm that surrounds the impellers from an outer peripheral side; a suction-side casing head disposed separately from the diaphragm on a side on which fluid is sucked; a temperature controlling mechanism that is provided inside the suction-side casing head and is configured to control ambient temperature through flow of a heating medium; a heat insulating body disposed between the suction-side casing head and the diaphragm; and a locking structure that locks the heat insulating body and the suction-side casing head
(Continued)

with each other to be relatively displaceable in a radial direction.

10 Claims, 9 Drawing Sheets

(51) Int. Cl.
*F04D 29/58* (2006.01)
*F04D 29/62* (2006.01)

(56) References Cited

FOREIGN PATENT DOCUMENTS

| | | | |
|---|---|---|---|
| JP | S54-055505 | U | 4/1979 |
| JP | 2013-513064 | A | 4/2013 |
| JP | 2014-125912 | A | 7/2014 |
| WO | 2011/069909 | A1 | 6/2011 |

OTHER PUBLICATIONS

International Preliminary Report on Patentability issued in corresponding International Application No. PCT/JP2018/005871, dated Sep. 12, 2019 (6 pages).

* cited by examiner

CENTRIFUGAL COMPRESSOR

TECHNICAL FIELD

The present invention relates to a centrifugal compressor that uses impellers to compress a fluid.

BACKGROUND ART

A centrifugal compressor used in an industrial process and a process plant causes fluid such as air and gas to flow through rotating impellers in a radial direction, and uses centrifugal force generated at that time to compress the fluid. The centrifugal compressor includes a casing and a rotor accommodated inside the casing as a basic configuration. The rotor includes a shaft rotatably provided in the casing and a plurality of impellers fixed to an outer peripheral surface of the shaft.

The centrifugal compressor is classified into a single-stage centrifugal compressor with a single impeller and a multistage centrifugal compressor in which a plurality of impellers are arranged in series in a rotation axis direction. The latter multistage centrifugal compressor is heavily used.

As an object to be compressed by the centrifugal compressor, boil off gas (BOG) is well-known as described in, for example, Patent Literature 1. For example, LNG (Liquefied Natural Gas) boil off gas is extremely low-temperature fluid. In the centrifugal compressor, in particular at the beginning of operation, a periphery of a gas suction passage is exposed to extremely low temperature, whereas an outer peripheral surface of the centrifugal compressor is exposed to atmospheric temperature, which causes large temperature difference. As a result, thermal stress associated with contraction of components occurs on the periphery of the suction passage. To reduce the temperature difference between the inside and the outside of the centrifugal compressor, Patent Literature 1 proposes to heat the periphery of the suction passage by oil as a heating medium.

CITATION LIST

Patent Literature

Patent Literature 1: JP 2013-513064 W

SUMMARY OF INVENTION

Technical Problem

To reduce the temperature difference between the inside and the outside of the centrifugal compressor by heating with oil, a large amount of oil is necessary, and cost increase by incidental facilities and equipment for heating with oil is not ignorable.

On the other hand, a casing forming an outer shell of the centrifugal compressor and internal components provided inside the casing are different in thermal responsiveness from each other based on difference of thermal capacity. Accordingly, it is necessary to consider difference in thermal deformation (or thermal expansion) between a period from activation to normal operation and a period from the normal operation to stoppage of the centrifugal compressor.

Accordingly, an object of the present invention is to provide a centrifugal compressor that makes it possible to reduce thermal contraction on the periphery of the gas suction passage at the beginning of the operation by a heating medium at low flow rate and to cope with thermal deformation occurred during the operation as well.

Solution to Problem

A centrifugal compressor according to the present invention includes a rotor that includes a shaft rotatably disposed inside a casing and impellers fixed to an outer periphery of the shaft, a diaphragm that surrounds the impellers from an outer peripheral side, a suction-side casing head disposed separately from the diaphragm on a side on which fluid is sucked, a temperature controlling mechanism that is provided inside the suction-side casing head and is configured to control ambient temperature through flow of a heating medium, a heat insulating body disposed between the suction-side casing head and the diaphragm, and a locking structure that locks the heat insulating body and the suction-side casing head with each other to be relatively displaceable in a radial direction.

The locking structure preferably includes a locking protrusion provided on one of the suction-side casing head and the heat insulating body, and a locking groove that is provided on another of the suction-side casing head and the heat insulating body and into which the locking protrusion is inserted.

The locking protrusion is preferably provided integrally with or separated from one of the suction-side casing head and the heat insulating body.

The locking protrusion preferably slides inside the locking groove when the heat insulating body and the suction-side casing head are relatively displaced in the radial direction.

A plurality of the locking structures are preferably radially provided on a surface of the suction-side casing head and a surface of the heat insulating body that face each other.

In particular, the plurality of locking structures are preferably provided at equal intervals in a circumferential direction.

Advantageous Effects of Invention

The centrifugal compressor according to the present invention includes the heat insulating body sectioning the suction passage. Therefore, it is possible to reduce thermal contraction on the periphery of the gas suction passage at the beginning of the operation. In addition, in the centrifugal compressor according to the present invention, the heat insulating body and the suction-side casing head are relatively displaceable in the radial direction. This makes it possible to cope with difference of thermal deformation between the suction-side casing head and the heat insulating body through the operation process from activation to normal operation, and further to stoppage.

DESCRIPTION OF EMBODIMENTS

First Embodiment

Some embodiments of the present invention are described below with reference to accompanying drawings.

In the present embodiment, a multistage centrifugal compressor including a plurality of impellers is described as an example of a centrifugal compressor.

A centrifugal compressor 1 according to the present embodiment is used to compress extremely low-temperature LNG boil off gas (fluid F).

Figure 1:
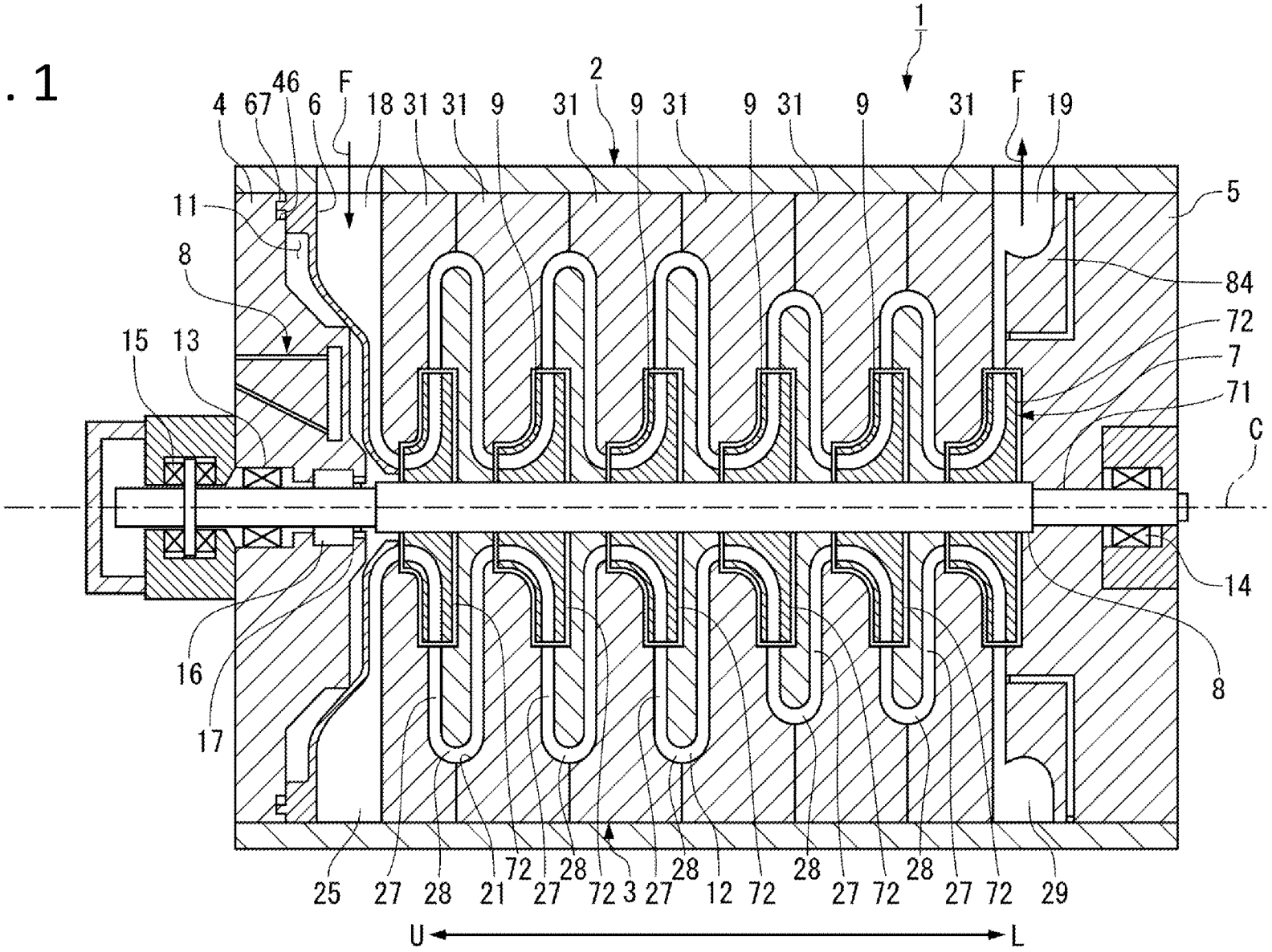
FIG. 1 is a cross-sectional view illustrating a schematic configuration of a centrifugal compressor according to a first embodiment of the present invention.

As illustrated in FIG. 1, the centrifugal compressor 1 includes a casing 2 forming an outer shell, and a rotor 7 that is rotatably supported inside the casing 2. The rotor 7 includes a shaft 71 extending along an axis C, and a plurality of impellers 72 fixed to an outer peripheral surface of the shaft 71. The centrifugal compressor 1 includes an oil heater 8 and a heat insulating body 6 in the casing 2. The oil heater 8 reduces temperature difference between an inside and an outside of a suction-side casing head 4, and the heat insulating body 6 suppresses heat transfer between the suction-side casing head 4 and a suction passage 18, in particular at the beginning of the operation.

The centrifugal compressor 1 according to the present embodiment can reduce a flow rate of a heating medium HM to be supplied to the oil heater 8, and can cope with thermal contraction on the periphery of the suction passage for the fluid F at the beginning of the operation and thermal deformation occurred during the operation, by the heat insulating body 6.

Components of the centrifugal compressor 1 are described below.

Note that, in the centrifugal compressor 1, a direction in which the axis C of the shaft 71 extends is referred to as an axis direction, and a direction orthogonal to the axis C is referred to as a radial direction. In addition, in the centrifugal compressor 1, upstream side U and downstream side L are defined based on a direction in which the fluid F to be compressed flows, as illustrated in FIG. 1. Note that the upstream side U and the downstream side L are defined relative to each other.

[Casing 2]

As illustrated in FIG. 1, a diaphragm 3 that surrounds the impellers 72 from an outer peripheral side, the suction-side casing head 4 that is disposed on the most upstream side U in the axis direction so as to be separated from the diaphragm 3, the heat insulating body 6 that is held by the suction-side casing head 4, and a discharge-side casing head 5 that is disposed on the most downstream side L in the axis direction so as to be separated from the diaphragm 3 are provided inside the casing 2.

Figure 5:
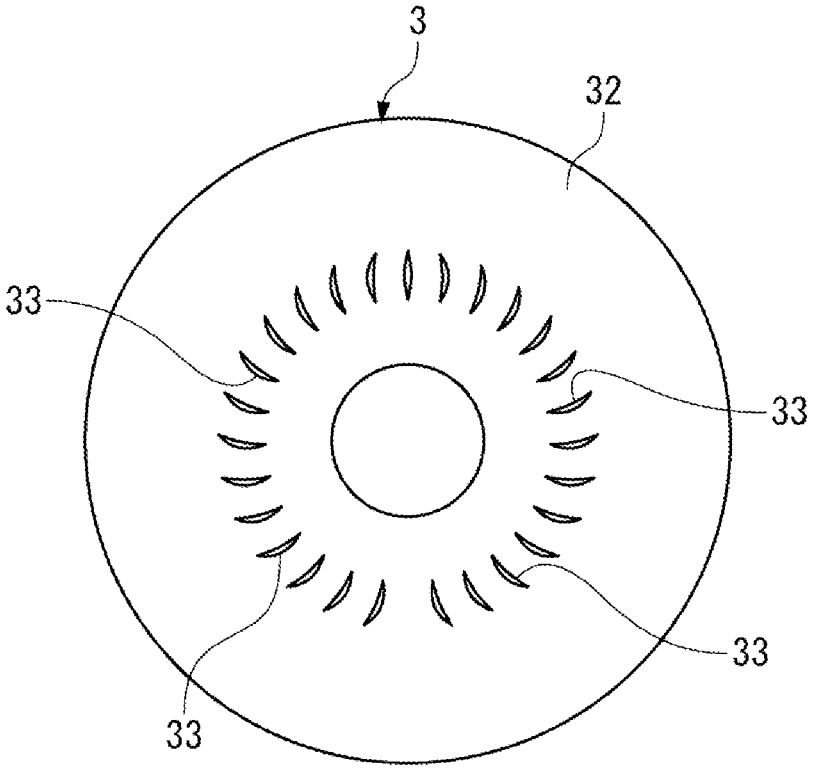
FIG. 5 illustrates a rectification blade provided on an end surface of a diaphragm of the centrifugal compressor of FIG. 1 as viewed from upstream side.

The diaphragm 3 according to the present embodiment includes, for example, a configuration in which a plurality of diaphragm pieces 31 are arranged in the axis direction. The diaphragm 3 includes a plurality of rectification blades 33 so as to rectify the flow of the fluid F sucked from the suction passage 18 to cause the fluid F to flow toward the downstream side L, as illustrated in FIG. 5.

Further, as illustrated in FIG. 1, a suction scroll 25 that sucks the fluid F and a discharge scroll 29 that discharges the fluid F are provided inside the casing 2.

[Suction-Side Casing Head 4]

Figure 2:
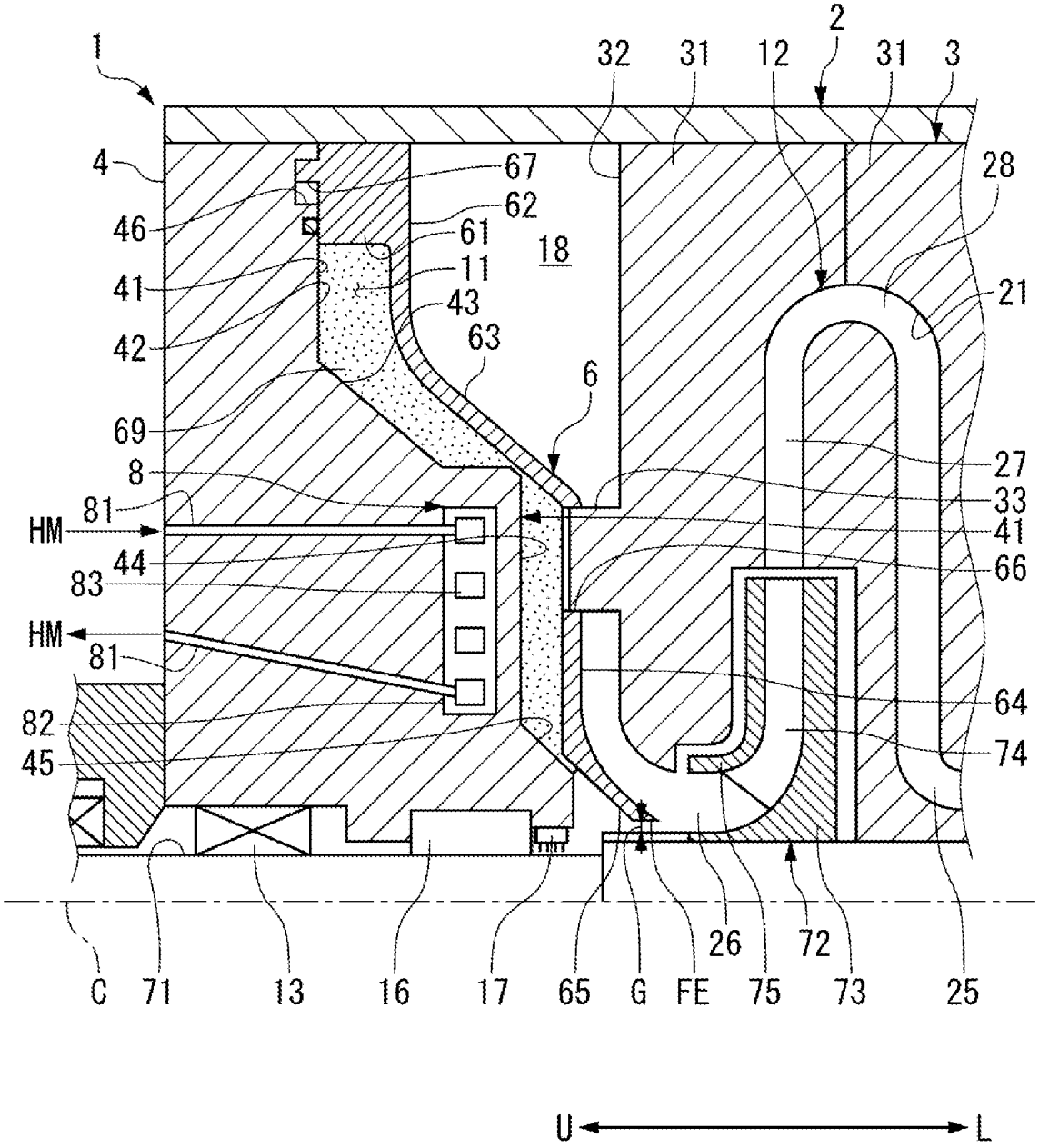
FIG. 2 is a cross-sectional view illustrating a periphery of a suction passage of the centrifugal compressor of FIG. 1.

As illustrated in FIG. 2, a head end surface 41 of the suction-side casing head 4 directed to the downstream side L is an annular surface extending along a circumferential direction. The head end surface 41 includes a first plane part 42, a first slope part 43, a second plane part 44, and a second slope part 45. The first plane part 42 is a surface that is located outside in the radial direction and is orthogonal to the axis C. The first slope part 43 is located inside the first plane part 42 in the radial direction and has a conical shape in which a diameter is reduced toward the downstream side L. The second plane part 44 is a surface that is located inside the first slope part 43 in the radial direction and is orthogonal to the axis C. The second slope part 45 is located inside the second plane part 44 in the radial direction and has a conical shape in which a diameter is reduced toward the downstream side L.

As illustrated in FIG. 1 and FIG. 2, the suction-side casing head 4 includes key grooves 46 into which respective keys 67 of the first plane part 42 are inserted, at positions facing the respective keys 67. Combination of one key 67 and one key groove 46 corresponds to a locking structure of the present invention.

A dimension in the radial direction of each of the key grooves 46 is larger than a difference of thermal expansion between the suction-side casing head 4 and the heat insulating body 6.

In addition, a dimension in the circumferential direction of each of the key grooves 46 is a size that enables the corresponding key 67 to be inserted without any gap.

A dimension (depth) in the axis direction of each of the key grooves 46 is equal to or larger than a dimension (height) in the same direction of the corresponding key 67. Accordingly, even when the keys 67 are inserted into innermost parts of the respective key grooves 46, a holding part 61 can come into contact with the first plane part 42.

Figure 3:
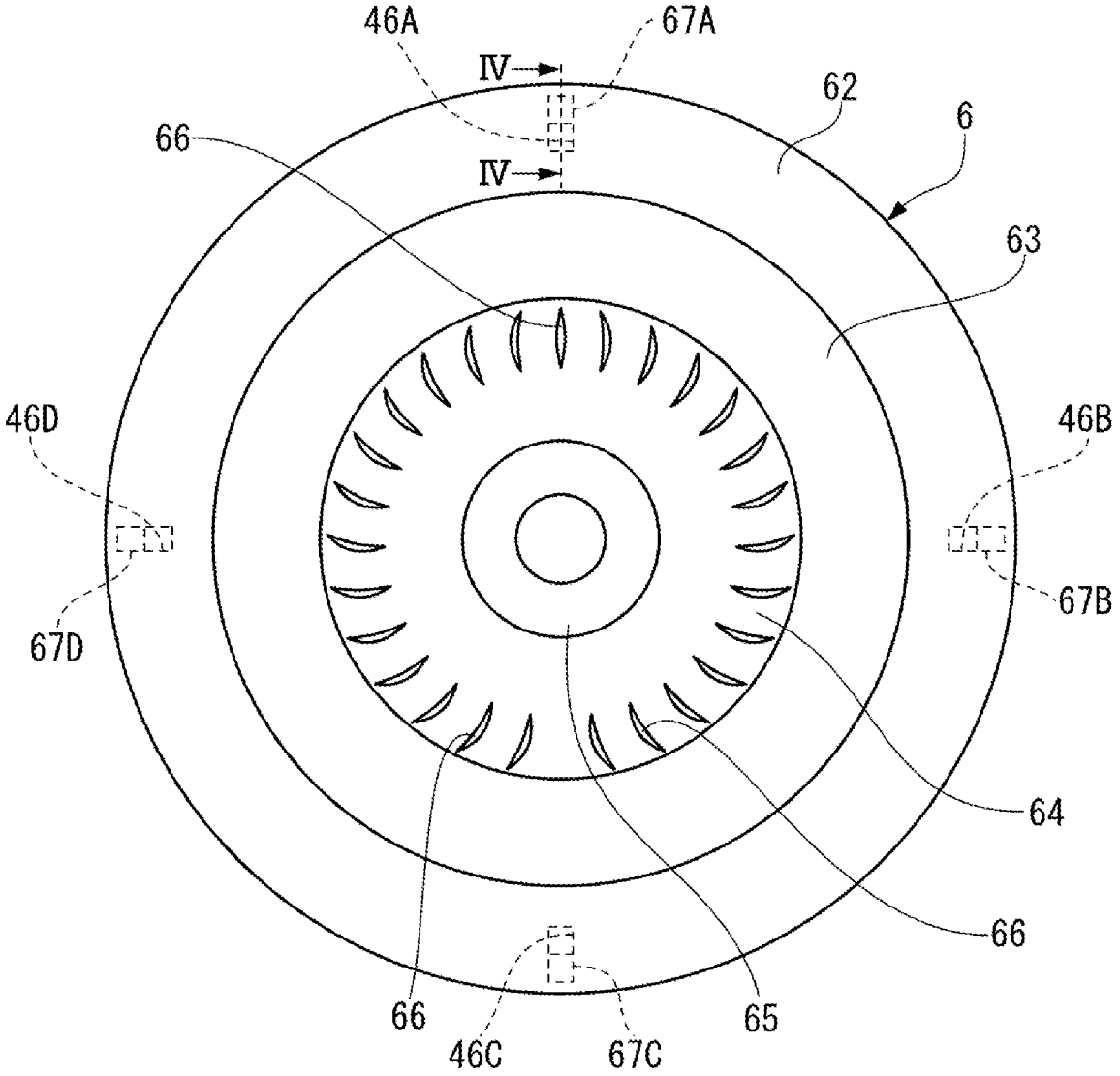
FIG. 3 is a plan view illustrating a heat insulating body of the centrifugal compressor according to the first embodiment.

As illustrated in FIG. 3, the suction-side casing head 4 according to the present embodiment includes four key grooves 46A, 46B, 46C, and 46D that are arranged with equal intervals while being shifted in phase by 90 degrees in the circumferential direction. The four key grooves 46A to 46D are concentrically provided.

Note that, in a case where it is unnecessary to distinguish the key grooves 46A to 46D from one another, the key grooves 46A to 46D are simply referred to as the key grooves 46. This is true of keys 67A to 67D described later.

As illustrated in FIG. 1, a dry gas seal 16 is provided inside the suction-side casing head 4 in the radial direction.

The dry gas seal 16 is provided farther on the downstream side L than a first journal bearing 13. The dry gas seal 16 is a sealing device that ejects gas such as dry gas to airtightly seal surroundings of the shaft 71. In addition, a seal fin 17 that includes a plurality of fins is provided farther on the downstream side L than the dry gas seal 16.

Note that the sealing device is not limited to the dry gas seal 16, and a sealing device that can seal a gap between the suction-side casing head 4 and the shaft 71 can be appropriately adopted. For example, a labyrinth seal may be disposed as the sealing device between the suction-side casing head 4 and the shaft 71.

If large temperature difference is sharply generated between the inside and the outside of the suction-side casing head 4 and the suction-side casing head 4 is thermally contracted at the beginning of the operation, the sealed state by the sealing device may be deteriorated. Accordingly, in the present embodiment, the oil heater 8 described later is provided and the heat insulating body 6 is also provided to prevent the large temperature difference from being generated at the beginning of the operation.

As illustrated in FIG. 1, the suction-side casing head 4 includes the oil heater 8 that is a temperature controlling mechanism heating the suction-side casing head 4. The oil heater 8 is provided to control temperature inside/outside the centrifugal compressor 1, in particular, to reduce the temperature difference at the beginning of the operation of the centrifugal compressor 1. As illustrated in FIG. 2, the oil heater 8 includes a conduit 81 provided inside the suction-side casing head 4, and an oil heater body 82 connected to the conduit 81, and the heating medium HM flows to the oil heater body 82 through the conduit 81.

The conduit 81 is connected to a supply source of the heating medium HM. The oil heater body 82 has an annular shape, and is provided so as to surround the shaft 71 as illustrated in FIG. 2. The oil heater body 82 includes a heating medium passage 83 through which the heating medium HM supplied through the conduit 81 circulates. As the heating medium HM, for example, the lubricant same as the lubricant supplied to the first journal bearing 13 and a second journal bearing 14 (FIG. 1) can be supplied to the oil heater 8. Changing the temperature of the heating medium HM makes it possible to change the heating temperature of the suction-side casing head 4, or to cool the suction-side casing head 4 in some cases.

[Heat Insulating Body 6]

As illustrated in FIG. 3, the heat insulating body 6 is a plate member having an annular plane shape, and includes outer-diameter side and inner-diameter side. As illustrated in FIG. 2 and FIG. 3, the heat insulating body 6 includes the holding part 61, a first disc part 62, a first conical part 63, a second disc part 64, and a second conical part 65. The holding part 61 is located on the outer-diameter side. The first disc part 62 is provided on one side of the holding part 61 in the axis direction. The first conical part 63 is connected to the inner-diameter side relative to the first disc part 62. The second disc part 64 is connected to the inside of the first conical part 63 in the radial direction. The second conical part 65 is connected to the inside of the second disc part 64 in the radial direction.

Respective main surfaces of the first disc part 62 and the second disc part 64 are orthogonal to the axis C. The first conical part 63 and the second conical part 65 each include a conical shape in which a diameter is reduced toward the downstream side L.

When the keys 67 are inserted into the respective key grooves 46, the holding part 61 comes into contact with the first plane part 42 as illustrated in FIG. 2. The holding part 61 is an annular part extending in the circumferential direction.

The holding part 61 includes the keys 67 on the surface facing the suction-side casing head 4. The keys 67 are provided so as to protrude from the holding part 61 toward the upstream side U.

As illustrated in FIG. 3, the heat insulating body 6 according to the present embodiment includes the four keys 67A, 67B, 67C, and 67D that are arranged with equal intervals while being shifted in phase by 90 degrees in the circumferential direction. The four keys 67A to 67D are concentrically provided.

When the keys 67A to 67D are respectively inserted into the key grooves 46A to 46D, the heat insulating body 6 is held by the suction-side casing head 4.

As illustrated in FIG. 2, when the keys 67 are inserted into the respective key grooves 46, the heat insulating body 6 is held by the first plane part 42 of the suction-side casing head 4 through the holding part 61 while being positioned in the circumferential direction. In this state, the heat insulating body 6 includes a cantilever structure held by the first plane part 42 only through the holding part 61. In other words, an inner-diameter end of the heat insulating body 6 forms a free end FE, and a gap G is provided between the free end FE of the heat insulating body 6 and the outer peripheral surface of the shaft 71. Since the inner-diameter side of the heat insulating body 6 forms the free end FE, the heat insulating body 6 is thermally expanded and thermally contracted in the radial direction without being especially restricted.

Figure 4A:
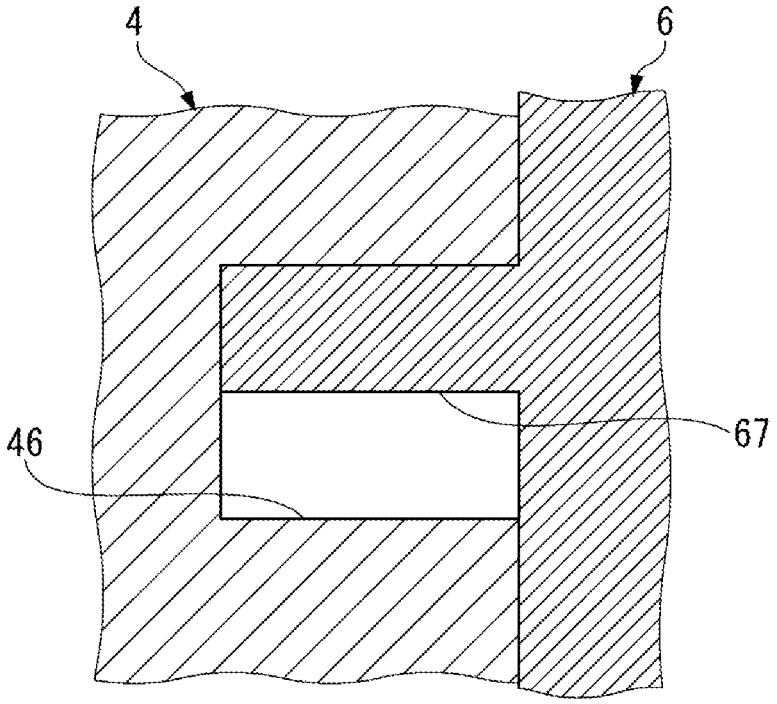
FIG. 4A and FIG. 4B each illustrate a state of interference between the heat insulating body and a suction-side casing head of the centrifugal compressor of FIG. 1, FIG. 4A illustrating a state at activation, and FIG. 4B illustrating a state during operation.
Figure 4B:
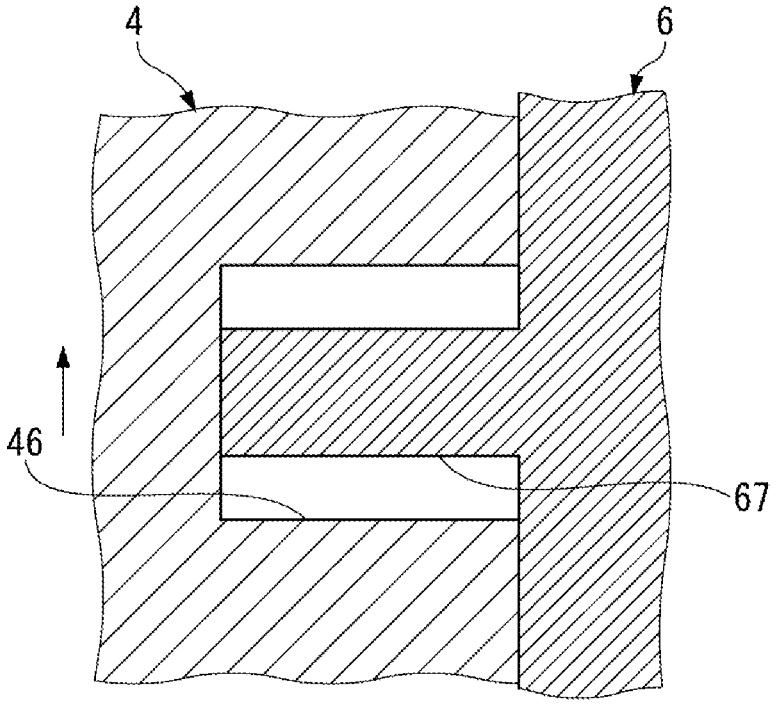

The keys 67 are displaced inside the respective key grooves 46 in the radial direction along with thermal expansion and thermal contraction in the radial direction of the heat insulating body 6, or along with thermal expansion and thermal contraction in the radial direction of the suction-side casing head 4. In other words, in the state where the keys 67 are inserted into the respective key grooves 46 as illustrated in FIG. 4A, when the thermal expansion in the radial direction of the suction-side casing head 4 heated by the oil heater 8 is larger than that of the heat insulating body 6, the keys 67 are relatively displaced toward the inner diameter inside the respective key grooves 46 as illustrated in FIG. 4B as a result of displacement of the key grooves 46 outward in the radial direction.

The thermal expansion in the radial direction of the suction-side casing head 4 heated by the oil heater 8 is larger than that of the heat insulating body 6. Therefore, the keys 67 are inserted into the respective key grooves 46 so as to be relatively displaceable toward the inner diameter inside the respective key groove 46 during the operation of the centrifugal compressor 1.

As illustrated in FIG. 2, an annular space functioning as a heat insulating space 11 is provided between the heat insulating body 6 and the head end surface 41 of the suction-side casing head 4.

The heat insulating space 11 is filled with a heat insulating material 69 without any gap. The heat insulating material 69 makes the heat of the heat insulating body 6 difficult to be transferred to the suction-side casing head 4. The heat insulating space 11, however, is not necessarily filled with the heat insulating material 69.

As illustrated in FIG. 3, the heat insulating body 6 includes interference maintaining grooves 66 at positions corresponding to a plurality of rectification blades 33 described later provided on the diaphragm 3. The plurality of interference maintaining grooves 66 are provided at predetermined intervals in the circumferential direction on the second disc part 64 so as to penetrate through front and rear surfaces of the second disc part 64. Opening areas of the respective interference maintaining grooves 66 are determined such that the rectification blades 33 are inserted into the respective interference maintaining grooves 66 with substantially no gap and are preferably slidable with receiving almost no load.

Note that the example in which the interference maintaining grooves 66 penetrate through the front and rear surfaces of the second disc part 64 is illustrated here; however, the interference maintaining grooves 66 do not necessarily penetrate through the front and rear surfaces of the heat insulating body 6 as long as interference between the heat insulating body 6 and the rectification blades 33 can be maintained.

[Rectification Blade 33]

The rectification blades 33 rectify the flow of the fluid F sucked from the suction passage 18 to cause the fluid F to flow toward the downstream side L.

As illustrated in FIG. 2, the rectification blades 33 are provided so as to protrude toward the upstream side U from an end surface 32 of the diaphragm 3 provided on the most upstream side U.

In the present embodiment, the plurality of rectification blades 33 are provided at predetermined intervals in the circumferential direction on the end surface 32 as illustrated in FIG. 5. Note that the rectification blades 33 may be formed integrally with the diaphragm 3 by, for example, machining, or may be fabricated separately from the diaphragm 3 and be joined to and fixed to the end surface 32 by an appropriate method.

As illustrated in FIG. 2, front ends of the rectification blades 33 are inserted into the respective interference maintaining grooves 66. The relationship in which the front ends of the rectification blades 33 are inserted into the respective interference maintaining grooves 66 is constantly maintained irrespective of the operation state of the centrifugal compressor 1. More specifically, lengths of the rectification blades 33 and depths of the interference maintaining grooves 66 are set such that the front ends of the rectification blades 33 remain in the respective interference maintaining grooves 66 of the heat insulating body 6 as illustrated in FIG. 6B even if the rectification blades 33 are displaced in the direction X separating from the heat insulating body 6 at a maximum. Note that, as described later, the rectification blades 33 advance and retreat in the axis C direction inside the respective interference maintaining grooves 66 and depths where the rectification blades 33 are inserted into the respective interference maintaining grooves 66 are varied.

[Rotor 7]

As illustrated in FIG. 1, the rotor 7 includes the shaft 71 extending along the axis C and the plurality of impellers 72 that are fixed to the outer peripheral surface of the shaft 71.

[Shaft 71]

As illustrated in FIG. 1, the shaft 71 is disposed coaxially with the casing 2 inside the cylindrical casing 2.

More specifically, the first journal bearing 13 is provided on the inside of the suction-side casing head 4 in the radial direction. The first journal bearing 13 is a bearing device that rotatably supports an end part of the shaft 71 on the upstream side U. Further, a thrust bearing 15 that supports the end part of the shaft 71 on the upstream side U is provided farther on the upstream side U than the first journal bearing 13. The first journal bearing 13 is fixed to the inside of the suction-side casing head 4, and the thrust bearing 15 is fixed to the outside of the suction-side casing head 4.

A second journal bearing 14 that rotatably supports an end part of the shaft 71 on the downstream side L is provided on the inside of the discharge-side casing head 5 in the radial direction. The second journal bearing 14 is fixed to the inside of the discharge-side casing head 5.

[Impeller 72]

The impellers 72 use centrifugal force that is generated when the impellers 72 rotate together with the shaft 71, to forcibly feed the fluid F that flows from the upstream side U toward the downstream side L, toward the outside in the radial direction. Therefore, as illustrated in FIG. 1 and FIG. 2, a fluid passage 12 that causes the fluid F to flow from the upstream side U toward the downstream side L is provided inside the casing 2.

As illustrated in FIG. 1, the impellers 72 are arranged in six stages with intervals in the axis direction. As illustrated in FIG. 2, each of the impellers 72 includes a hub 73, a plurality of vanes 74, and a shroud 75. The hub 73 has a substantially disc shape in which the diameter is gradually increased toward the downstream side L. The plurality of vanes 74 are radially attached to the hub 73 and are arranged in the circumferential direction. The shroud 75 is attached so as to cover front end side of the plurality of vanes 74 in the circumferential direction.

Note that the example in which the impellers 72 are provided in the six stages is illustrated; however, the present invention is applicable to the centrifugal compressor including the impellers 72 in at least one stage.

[Fluid Passage 12]

Next, the fluid passage 12 provided inside the casing 2 is described. As illustrated in FIG. 1 and FIG. 2, the fluid passage 12 mainly includes the suction passage 18, a diffuser passage 27, a return passage 28, and a discharge passage 19.

As illustrated in FIG. 1, the suction passage 18 is provided on the end part of the casing 2 on the upstream side U in order to guide the fluid F from the outside to the inside of the casing 2.

As illustrated in FIG. 2, the suction passage 18 is provided between the heat insulating body 6 and the diaphragm 3. In other words, the upstream side U of the suction passage 18 is sectioned by the heat insulating body 6 held by the suction-side casing head 4, and the downstream side L of the suction passage 18 is sectioned by the end surface 32 of the diaphragm 3. The heat insulating space 11 is provided between the heat insulating body 6 and the suction-side casing head 4.

The diffuser passage 27 and the return passage 28 are provided to cause the fluid F to flow from the upstream side U toward the downstream side L.

As illustrated in FIG. 2, an internal space 21 that communicates with each of the suction passage 18 and the discharge passage 19 and is repeatedly decreased and increased in diameter is provided inside the casing 2. The internal space 21 functions as a space accommodating the impellers 72, and the internal space 21 excluding the impellers 72 functions as the diffuser passage 27 and the return passage 28. Accordingly, the suction passage 18 and the discharge passage 19 communicate with each other through the impellers 72 and the fluid passage 12.

As illustrated in FIG. 1, the discharge passage 19 is provided on the end part of the casing 2 on the downstream side L to cause the fluid F to flow to the outside. The discharge passage 19 is provided between a shielding member 84 on the discharge side and the diaphragm 3.

The fluid passage 12 is provided so as to extend toward the downstream side L while meandering in the radial direction and to connect the adjacent impellers 72 and 72 inside the casing 2 because the diffuser passage 27 and the return passage 28 are alternately provided, as illustrated in FIG. 1. The fluid F is stepwisely compressed every time the fluid F passes through the impellers 72 in the plurality of stages while flowing through the fluid passage 12.

[Effects of Centrifugal Compressor 1]

The centrifugal compressor 1 according to the first embodiment achieves the following effects.

Since the centrifugal compressor 1 includes the oil heater 8, the centrifugal compressor 1 can heat or cool the suction-side casing head 4 through selection of the temperature of the heating medium HM to be supplied. Accordingly, in a case where the centrifugal compressor 1 compresses the extremely low-temperature fluid F, supplying the heating medium HM at high temperature makes it possible to reduce the temperature difference between the inside and the outside of the centrifugal compressor 1, more specifically, the temperature difference between the inside and the outside of the suction-side casing head 4.

Further, the centrifugal compressor 1 includes the heat insulating body 6 between the suction-side casing head 4 and the suction passage 18, which makes it possible to suppress heat transfer between the suction-side casing head 4 and the suction passage 18. Accordingly, in the case where the extremely low-temperature fluid F is compressed, the temperature decrease of the suction-side casing head 4 caused by the fluid F is suppressed. This makes it possible to reduce the flow rate of the heating medium HM to be supplied to the oil heater 8. In addition, since the centrifugal compressor 1 includes the heat insulating space 11 between the suction-side casing head 4 and the heat insulating body 6, it is possible to further suppress the heat transfer between the fluid F and the suction-side casing head 4.

As described above, providing the oil heater 8 as well as the heat insulating space 11 and the heat insulating body 6 enables the centrifugal compressor 1 to suppress the temperature difference between the inside and the outside of the centrifugal compressor 1 in a case where the centrifugal compressor 1 compresses the fluid F, the temperature of which is largely different from the ambient temperature. As a result, defect of the sealing device on the periphery of the suction passage 18 of the centrifugal compressor 1 caused by thermal deformation that may occur at the beginning of the operation is particularly prevented by the heating medium HM at a lower flow rate.

In contrast, when the operation of the centrifugal compressor 1 is continued, temperature of the suction-side casing head 4, the heat insulating body 6, and the diaphragm 3 are inevitably increased in turn. The thermal expansion and the thermal contraction of the suction-side casing head 4, the heat insulating body 6, and the diaphragm 3 are different from one another depending on the temperature during the operation of the centrifugal compressor 1 and the linear expansion coefficient. The centrifugal compressor 1 includes a structure to cope with the difference of the thermal expansion and the thermal contraction.

Unlike the structure of the present embodiment, a structure in which the heat insulating body 6 and the suction-side casing head 4 are fixed through, for example, fastening with bolts and relative displacement between the heat insulating body 6 and the suction-side casing head 4 is not allowed is assumed. In the structure, if the thermal expansion is different between the heat insulating body 6 and the suction-side casing head 4, one of the heat insulating body 6 and the suction-side casing head 4 restricts the thermal expansion in the radial direction of the other, which causes thermal stress. When the centrifugal compressor 1 compresses the extremely low-temperature fluid F, large thermal stress occurs at the fastening part because the thermal expansion in the radial direction of the suction-side casing head 4 heated by the oil heater 8 is larger than that of the heat insulating body 6.

In the present embodiment, however, the keys 67 as locking protrusions provided on the heat insulating body 6 are inserted into the respective key grooves 46 as locking grooves provided on the suction-side casing head 4, and the suction-side casing head 4 and the heat insulating body 6 are mutually locked so as to be relatively displaceable in the radial direction, as illustrated in FIG. 4A. In other words, even if the thermal expansion in the radial direction of the suction-side casing head 4 is larger than that of the heat insulating body 6, the keys 67 displace inside the respective key grooves 46 in the radial direction as illustrated in FIG. 4B, which makes it possible to suppress generation of thermal stress. As described above, in the centrifugal compressor 1, the state where the heat insulating body 6 and the suction-side casing head 4 are mutually locked is maintained by the locking mechanisms including the keys 67 and the key grooves 46 as long as the operation of the centrifugal compressor 1 is continued. This makes it possible to stably suppress heat transfer between the suction-side casing head 4 and the suction passage 18.

Next, measures against thermal deformation difference between the heat insulating body 6 and the diaphragm 3 are described.

When the rectification blades 33 are displaced in a direction separating from the heat insulating body 6 due to thermal deformation of the diaphragm 3, a gap may be generated between the heat insulating body 6 and the front ends of the rectification blades 33 if the front ends of the rectification blades 33 are merely brought into contact with the heat insulating body 6. If the gap is generated, the rectification effect for the fluid F due to the rectification blades 33 is not sufficiently obtainable.

Figure 6A:
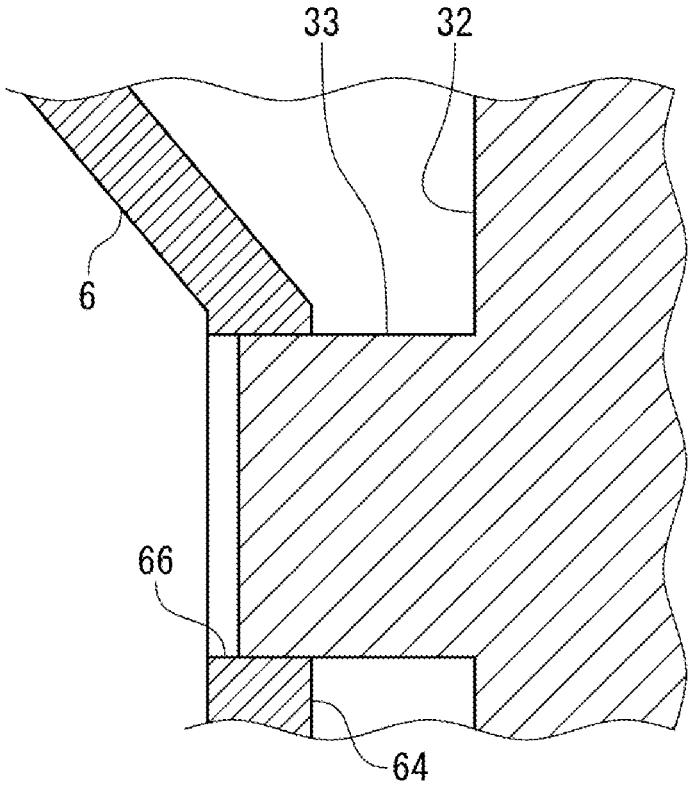
FIG. 6A and FIG. 6B each illustrate a state of interference between the heat insulating body and the rectification blade of the centrifugal compressor of FIG. 1, FIG. 6A illustrating deformation at activation and also illustrating deep interference between the heat insulating body and the rectification blade, and FIG. 6B illustrating deformation at stoppage and also illustrating shallow interference between the heat insulating body and the rectification blade.
Figure 6B:
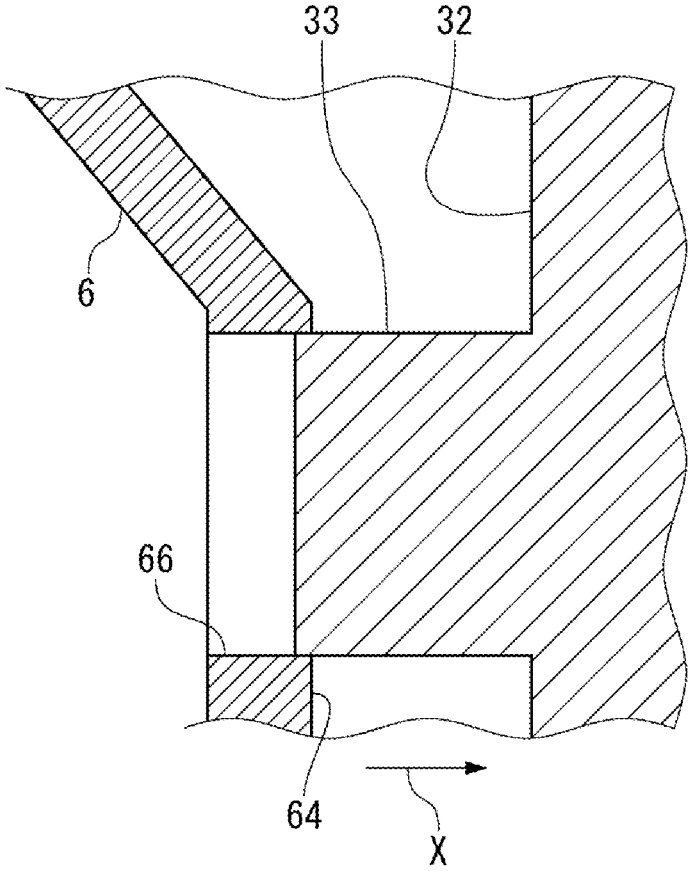

In the present embodiment, however, the front ends of the rectification blades 33 are inserted into the respective interference maintaining grooves 66 of the heat insulating body 6 as illustrated in FIG. 6A. Even if the thermal deformation occurs and the rectification blades 33 are displaced in the direction X separating from the heat insulating body 6 at the maximum, the front ends of the rectification blades 33 remain in the respective interference maintaining grooves 66 of the heat insulating body 6 as illustrated in FIG. 6B. As described above, in the centrifugal compressor 1, the interference state where the rectification blades 33 are inserted into the heat insulating body 6 is maintained as long as the operation of the centrifugal compressor 1 is continued. Therefore, the rectification effect for the fluid F by the rectification blades 33 is sufficiently obtainable, which achieves stable operation.

Modification of First Embodiment

Next, a modification of the first embodiment of the present invention is described with reference to FIGS. 7A to 7C. In the present embodiment, components similar to those of the first embodiment are denoted by the same reference numerals as those of the first embodiment, and description of such components is omitted.

The key grooves 46 are provided on the suction-side casing head 4 and the keys 67 are provided on the heat insulating body 6 in the first embodiment, whereas the keys and key grooves are reversely provided in the modification.

Figure 7A:
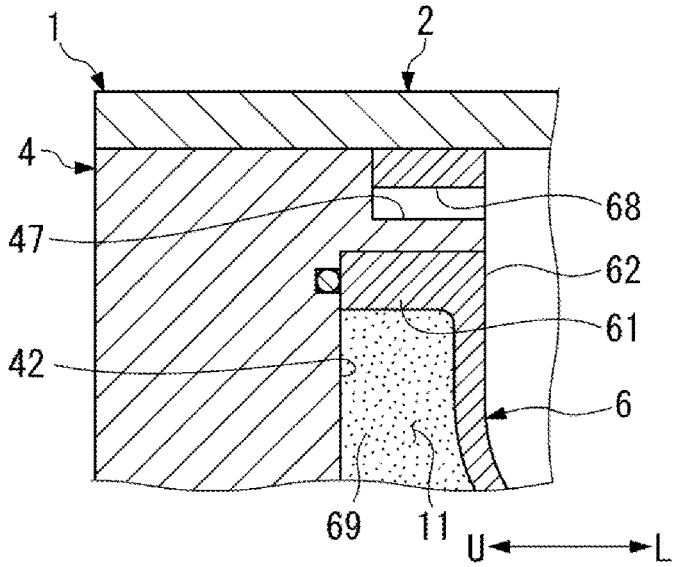
FIG. 7A, FIG. 7B and FIG. 7C each illustrate a modification of the first embodiment, FIG. 7A illustrating a configuration of the modification, FIG. 7B illustrating a state at activation, and FIG. 7C illustrating a state during operation.
Figure 7B:
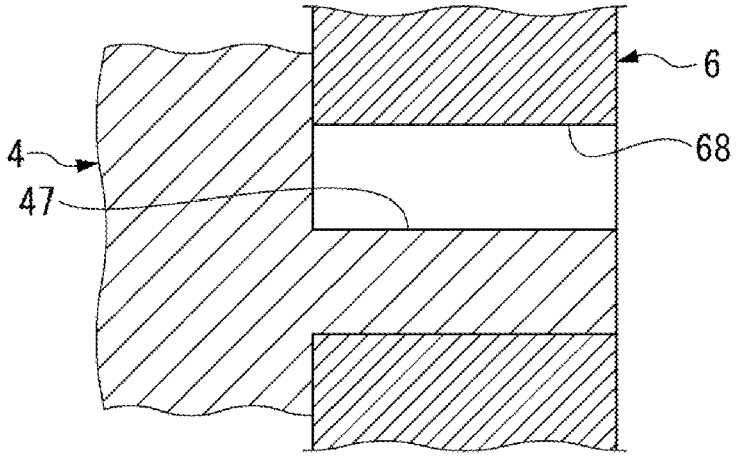

In other words, as illustrated in FIG. 7A, key grooves 68 that penetrate through the front and rear surfaces of the heat insulating body 6 are provided on the heat insulating body 6. Keys 47 are provided on the suction-side casing head 4 so as to protrude from the first plane part 42 toward the downstream side L. As illustrated in FIG. 7B, the keys 47 are inserted into the respective key grooves 68. One key 47 and one key groove 68 correspond to the locking structure of the present invention.

Figure 7C:
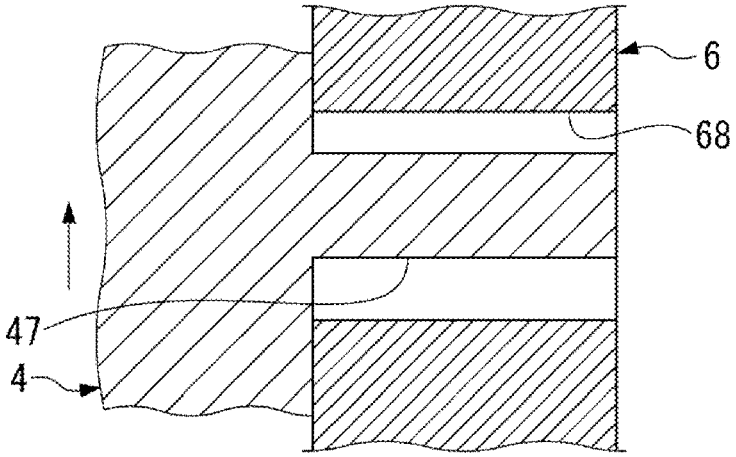

In the present embodiment, when the suction-side casing head 4 thermally expands in the radial direction more than the heat insulating body 6, the keys 47 displace inside the respective key grooves 68 outward in the radial direction as illustrated in FIG. 7C.

Note that the keys 67 and the key grooves 68 may be provided on the heat insulating body 6 and the key grooves 46 and the keys 47 may be provided on the suction-side casing head 4 so as to correspond to the keys 67 and the key grooves 68 of the heat insulating body 6.

Second Embodiment

Figure 8:
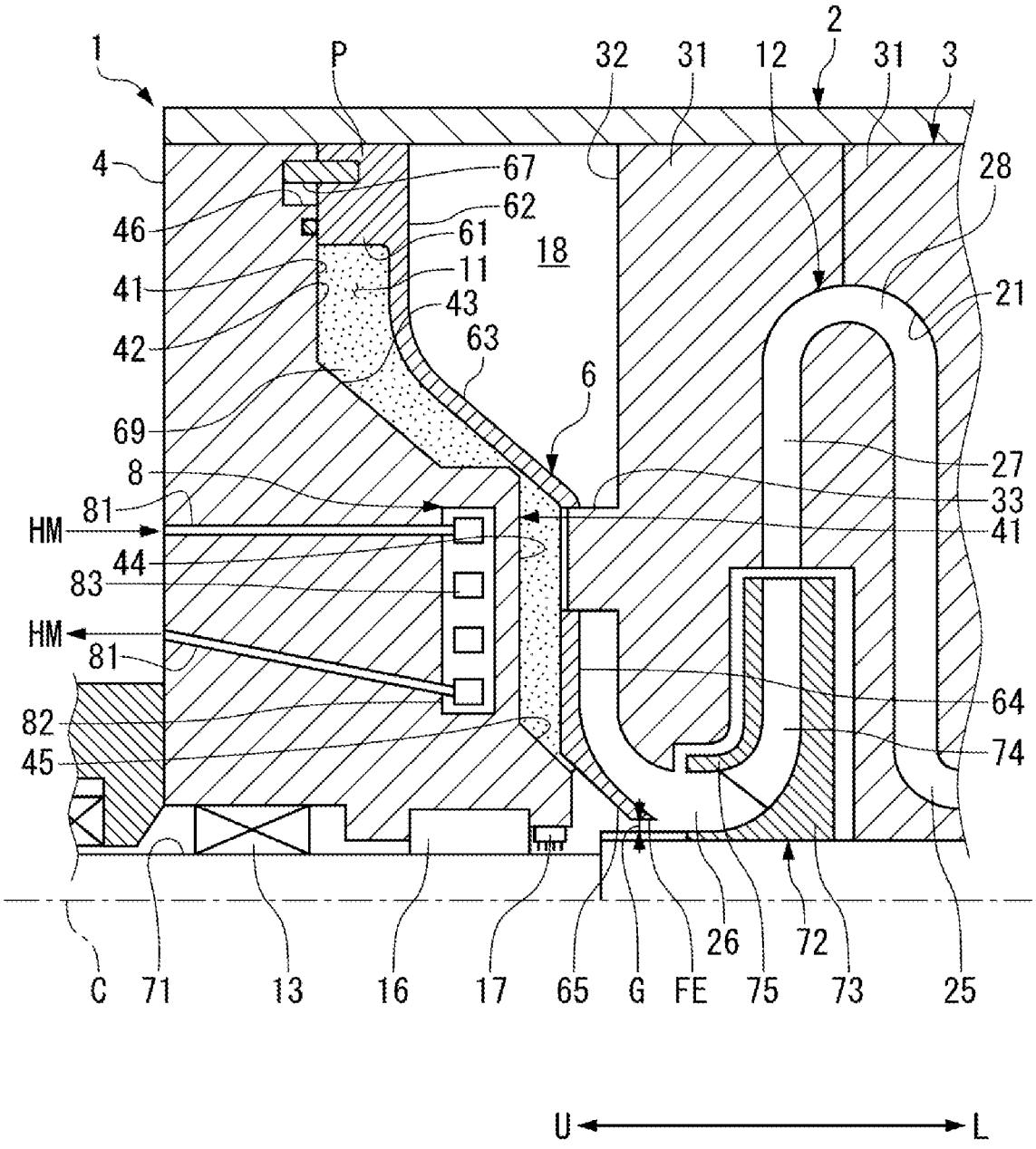
FIG. 8 is a cross-sectional view illustrating a periphery of a suction passage of a centrifugal compressor according to a second embodiment.

Next, a second embodiment of the present invention is described with reference to FIG. 8. Note that, in the present embodiment, components similar to those of the first embodiment are denoted by the same reference numerals as those of the first embodiment, and description of such components is omitted.

The key grooves 46 are provided on the suction-side casing head 4 and the keys 67 are provided on the heat insulating body 6 in the first embodiment, whereas pins P as locking protrusions are detachably provided on the heat insulating body 6 in the second embodiment.

When the pins P are used as the parts coming into contact with the suction-side casing head 4 inside the key grooves 46, even if the pins P are worn, it is sufficient to replace the pins P.

Other than the above description, the configurations described in the above-described embodiments may be selected or appropriately modified without departing from the scope of the present invention.

Figure 9A:
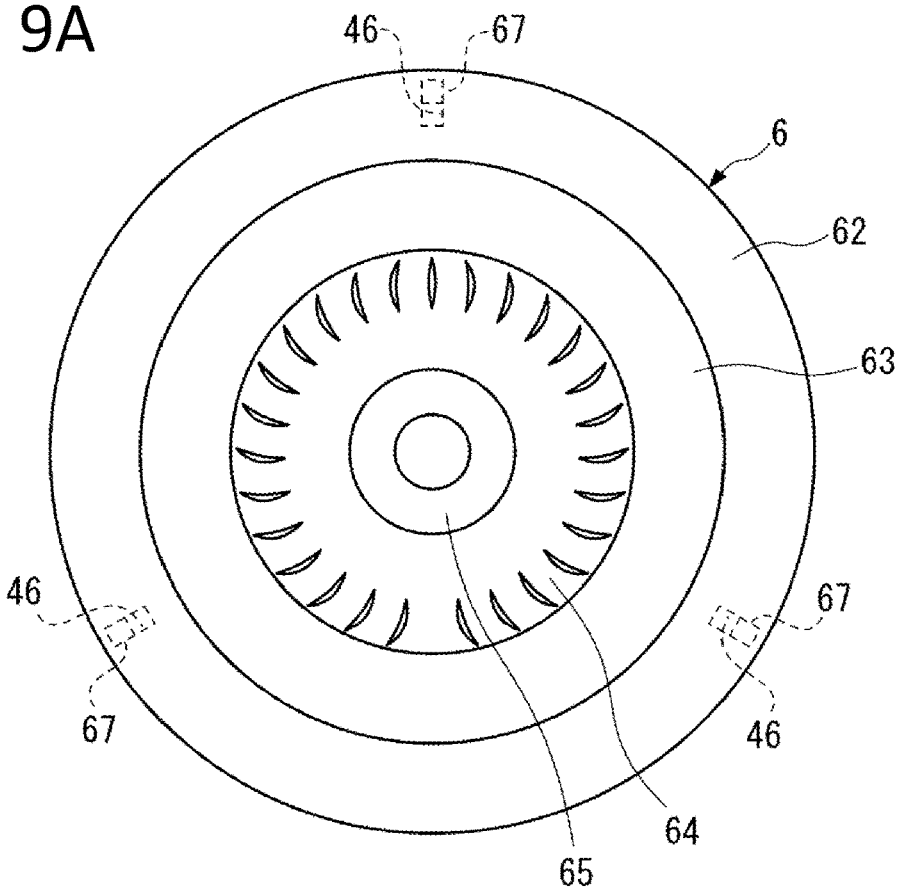
FIG. 9 illustrates still another embodiment.
Figure 9B:
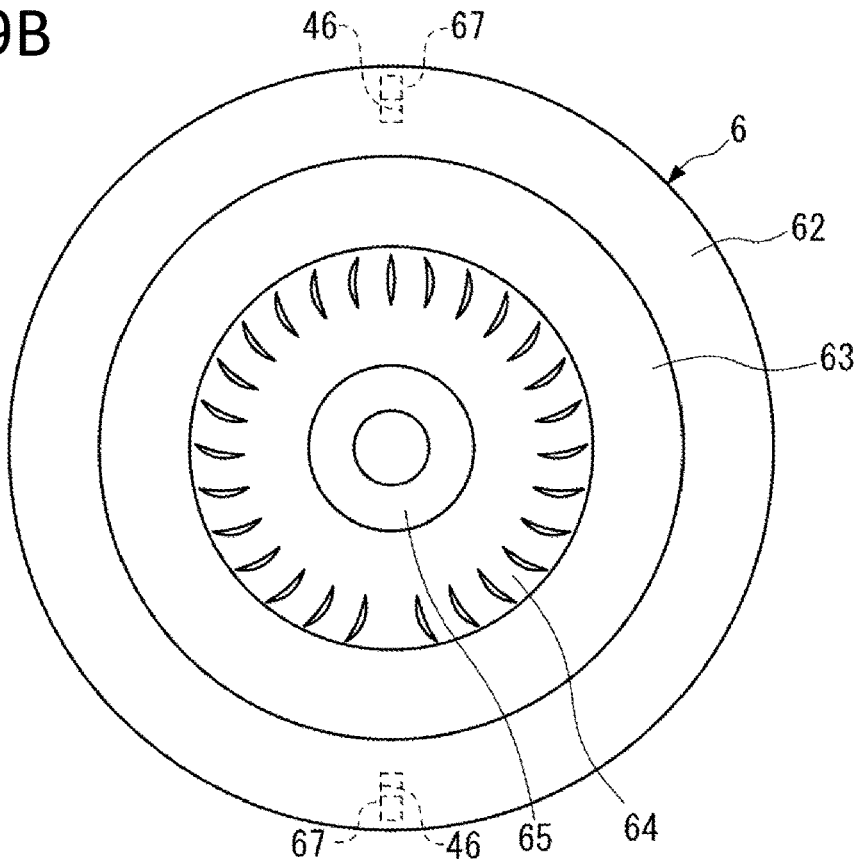

For example, in the first embodiment, four pairs of the keys 67 and the key grooves 46 are provided at equal intervals while being shifted in phase by 90 degrees in the circumferential direction; however, the present invention is not limited thereto. Three pairs of the keys 67 and the key grooves 46 may be provided at equal intervals while being shifted in phase by 120 degrees in the circumferential direction as illustrated in FIG. 9A, or two pairs of the keys 67 and the key grooves 46 may be provided on one straight line as illustrated in FIG. 9B.

In addition, the pairs of the keys 67 and the key grooves 46 may not be provided at equal intervals in the circumferential direction as long as the suction-side casing head 4 and the heat insulating body 6 are mutually locked so as to be relatively displaceable in the radial direction.

Further, the configuration of the oil heater 8 and the configuration of the heat insulating body 6 merely illustrate an example of the present invention, and the configurations are optional as long as the effect of reducing the temperature difference between the inside and the outside is achieved.

This is true of the method of maintaining the interference state between the rectification blades and the heat insulating body. The configuration thereof is optional as long as the rectification effect by the rectification blades is secured. For example, the rectification blades 33 may be provided on the heat insulating body 6 side and the interference maintaining grooves 66 may be provided on the end surface 32 side of the diaphragm 3.

REFERENCE SIGNS LIST

1 Centrifugal compressor
11 Heat insulating space
12 Fluid passage
13 First journal bearing
14 Second journal bearing
15 Thrust bearing
16 Dry gas seal
17 Seal fin
18 Suction passage
19 Discharge passage
2 Casing
21 Internal space
25 Suction scroll
26 Compression passage
27 Diffuser passage
28 Return passage
29 Discharge scroll
3 Diaphragm
31 Diaphragm piece
32 End surface
33 Rectification blade
4 Suction-side casing head
41 Head end surface
42 First plane part
43 First slope part
44 Second plane part
45 Second slope part
46 Key groove
47 Key
5 Discharge-side casing head
6 Heat insulating body
61 Holding part
62 First disc part
63 First conical part
64 Second disc part
65 Second conical part
67 Key
68 Key groove
69 Heat insulating material
7 Rotor
71 Shaft
72 Impeller
73 Hub
74 Vane
75 Shroud
8 Oil heater
81 Conduit
82 Oil heater body
83 Heating medium passage
84 Shielding member
C Axis
F Fluid
FE Free end
G Gap
HM Heating medium
U Upstream side
L Downstream side
P Pin

The invention claimed is:

1. A centrifugal compressor, comprising:

a rotor that includes a shaft rotatably disposed inside a casing and impellers fixed to an outer periphery of the shaft;

a diaphragm that surrounds the impellers from an outer peripheral side;

a suction-side casing head disposed separately from the diaphragm on a side on which fluid is sucked;

a heater that is provided inside the suction-side casing head and is configured to control ambient temperature through flow of a heating medium;

a heat insulating body disposed between the suction-side casing head and the diaphragm and that suppresses heat transfer between the suction-side casing head and the fluid; and a locking structure that locks the heat insulating body and the suction-side casing head with each other to be relatively displaceable in a radial direction.

2. The centrifugal compressor according to claim 1, wherein the locking structure includes a locking protrusion provided on one of the suction-side casing head and the heat insulating body, and a locking groove that is provided on another of the suction-side casing head and the heat insulating body and into which the locking protrusion is inserted.

3. The centrifugal compressor according to claim 2, wherein the locking protrusion is provided integrally with or separated from one of the suction-side casing head and the heat insulating body.

4. The centrifugal compressor according to claim 3, wherein the locking protrusion slides inside the locking groove when the heat insulating body and the suction-side casing head are relatively displaced in the radial direction.

5. The centrifugal compressor according to claim 2, wherein the locking protrusion slides inside the locking groove when the heat insulating body and the suction-side casing head are relatively displaced in the radial direction.

6. The centrifugal compressor according to claim 2, wherein a plurality of locking structures are radially provided on a surface of the suction-side casing head and a surface of the heat insulating body that face each other.

7. The centrifugal compressor according to claim 6, wherein the plurality of the locking structures are provided at equal intervals in a circumferential direction.

8. The centrifugal compressor according to claim 1, wherein a plurality of locking structures are radially provided on a surface of the suction-side casing head and a surface of the heat insulating body that face each other.

9. The centrifugal compressor according to claim 8, wherein the plurality of the locking structures are provided at equal intervals in a circumferential direction.

10. The centrifugal compressor according to claim 1, wherein the diaphragm forms a diffuser of the fluid downstream of the impellers.

* * * * *